US007086224B1

(12) United States Patent
Perry

(10) Patent No.: US 7,086,224 B1
(45) Date of Patent: Aug. 8, 2006

(54) ROTATING MOTOR VEHICLE TAIL PIPE

(76) Inventor: Corey Perry, RR#1 Box 1416, Stroudsburg, PA (US) 18360

( * ) Notice: Subject to any disclaimer, the term of this patent is extended or adjusted under 35 U.S.C. 154(b) by 0 days.

(21) Appl. No.: 11/147,517

(22) Filed: Jun. 8, 2005

(51) Int. Cl.
*F01N 5/04* (2006.01)

(52) U.S. Cl. ..... 60/319; 60/317; D15/5; D12/194; 446/210; 446/211; 446/217; 446/218; 446/176

(58) Field of Classification Search ..... 60/317, 60/319; D15/5; D12/194; 446/217, 218, 446/210, 211, 176
See application file for complete search history.

(56) References Cited

U.S. PATENT DOCUMENTS

| | | | | | |
|---|---|---|---|---|---|
| 2,172,713 | A | * | 9/1939 | Rutherford | 181/225 |
| 3,417,549 | A | * | 12/1968 | Leosis | 96/136 |
| 4,220,219 | A | | 9/1980 | Flugger | |
| 4,339,918 | A | * | 7/1982 | Michikawa | 60/316 |
| 4,765,137 | A | * | 8/1988 | Sakurai et al. | 60/313 |
| 4,860,538 | A | | 8/1989 | Takeuchi | |
| 4,897,068 | A | * | 1/1990 | Jackson | 446/217 |
| 4,969,805 | A | * | 11/1990 | Romeo | 417/360 |
| 5,058,703 | A | | 10/1991 | Ealba et al. | |
| 5,058,704 | A | | 10/1991 | Sakamoto | |
| 5,282,361 | A | * | 2/1994 | Sung | 60/315 |
| 5,579,638 | A | | 12/1996 | Archer | |
| 5,884,666 | A | * | 3/1999 | Johnson | 138/39 |
| D447,456 | S | * | 9/2001 | Larson et al. | D12/194 |
| 6,520,739 | B1 | * | 2/2003 | Tsuji | 416/5 |
| 6,575,585 | B1 | * | 6/2003 | Nelson et al. | 362/35 |
| 6,719,085 | B1 | * | 4/2004 | Lee | 180/309 |
| 6,758,042 | B1 | * | 7/2004 | Huang | 60/597 |

* cited by examiner

*Primary Examiner*—Thomas Denion
*Assistant Examiner*—Loren Edwards
(74) *Attorney, Agent, or Firm*—Kenneth P. Glynn, Esq.

(57) ABSTRACT

A motor vehicle having at least three wheels, an internal combustion motor and a wheel drive mechanism, wherein the motor has an exhaust system connected thereto, includes a) an exhaust system having a first exhaust pipe and a second exhaust pipe with the first exhaust pipe being in a fixed position relative to the internal combustion motor, and the second exhaust being rotatably connected to the first exhaust pipe, and b) an exhaust pipe drive mechanism connected to the second exhaust pipe for rotation of the second exhaust pipe. The pipe drive mechanism may operate off some power source of the vehicle, operate independently of the vehicle power sources, may operate from exiting exhaust gases, ambient wind form motion of the vehicle, or a combination of the foregoing.

20 Claims, 6 Drawing Sheets

ROTATING MOTOR VEHICLE TAIL PIPE

BACKGROUND OF THE INVENTION

1. Field of the Invention

The present invention relates to a combined functional and decorative exhaust system for motor vehicles. The term "motor vehicle" as used herein means a motorized vehicle having at least one wide axle with two separate wheels thereon and at least one additional wheel on a separate axle. Hence, it includes three wheel minicars, three wheel trucks, three wheel open air vehicles, such as ATVs and trikes, as well as more common motor vehicles, such as autos, trucks, buses, tractors, semis, SUVs, and the like. It is particularly applicable to such vehicles with exhaust pipes, especially internal combustion driven motor vehicles with at least three wheels. More particularly it relates to a rotating motor vehicle exhaust pipe that may add dynamic and artistic appearance and may act as a hot exhaust gas heat dissipater, as well as an eye-catching safety feature that will, in some instances, make other drivers more readily aware of the presence of vehicle having the present invention. Thus, the present invention includes a first, fixed pipe and a second, rotating pipe rotatably connected to the first pipe, and a drive mechanism to rotate the second pipe. The term "exhaust pipe" and the term "tail pipe" may be considered different by some technicians, but are used herein interchangeably because, for purposes of this invention, any technical differences between the two are irrelevant.

2. Information Disclosure Statement

The following patents are representative of prior art of interest to the present invention technology:

U.S. Pat. No. 5,579,638 describes an adjustable exhaust system for use with two cycle motors. An insert section of pipe is interposed between a header pipe and a conventional tail pipe so that, when it is rotated, the overall length of the exhaust system is adjusted. The insert section is held in place between the tail pipe and a header extension pipe by a compressive force exerted by one or more springs attached between the header and the tail pipe. The insert features, on an end that slips over the header extension section, a series of graduated notches which mate with a protrusion, or "stop", formed on the mating end of a header extension section. This notch and stop combination determines the distance by which the insert section will be permitted to slip over the header extension section, and correspondingly, the overall length of the exhaust system.

U.S. Pat. No. 5,058,704 describes an improved muffler including a body with an exhaust inlet in the form of a porous pipe enclosed in a second porous pipe for diffusing exhaust gases into the interior of body. A pair of pipes introduces ambient air into the discharge region of the muffler. A constricted discharge opening of the body encircles the pipes and confines the helical vanes which impart a helical path to the exhaust gases just before mixing with ambient air from the pipes. A venture section with a bell shape outlet completes the tail pipe section. An auxiliary air inlet to the venture adds additional ambient air to the final outlet via ports. In addition embodiment, the venture section is within the muffler body. A constricted tube provides a direct path for a portion of the exhaust gases while the major quantity of exhaust gases traverse the helical paths defined by the vanes.

U.S. Pat. No. 5,058,703 describes an exhaust to reduce noise, an automotive exhaust tailpipe that has a convoluted surface at or near its outlet to generate pairs of counterrotating axial vortices within the exhaust gases just before or just after the gases exit the tailpipe. The convoluted surface of the tailpipe, or a thin-walled convoluted member, may be disposed within the tailpipe near its outlet end.

U.S. Pat. No. 4,860,538 describes several embodiments of motorcycle exhaust systems having forward and rearward exhaust pipes at least one of which extends transversely in a transversely extending expansion chamber for improving high speed performance. In addition, a variety of control valves are incorporated for varying the reflective area of the exhaust pipe ends so as to improve low speed and midrange performance.

U.S. Pat. No. 4,220,219 describes a lightweight muffler and method for muffling a noise component of a stream of gases. The muffler includes a chamber in which gases are directed side-by-side streams flowing in opposite directions. The streams are in contact with each other for the generation of sound dampening eddy currents in the chamber, but such contact does not break down the continuous, low resistance flow of gases through the muffler. The chamber is advantageously formed as a expansion chamber in which gases: enter one end of the chamber as an annular stream concentric with the inlet pipe to the muffler, travel along the inlet pipe to the other end of the chamber, are reversed, and travel as a concentric annular stream of greater diameter in the opposite direction down the length of the chamber for discharge into a passageway leading to the outlet tube to the muffler. A second similarly formed chamber for counterflow of opposed streams and the generation of eddy current there between is preferably formed proximate the outlet tube of the muffler.

Notwithstanding the prior art, the present invention is neither taught nor rendered obvious thereby.

SUMMARY OF THE INVENTION

The present invention relates to a combined functional and decorative exhaust system for internal combustion driven motor vehicles having at least three wheels, that includes a first, fixed exhaust pipe and a second, rotating exhaust pipe rotatably connected to the first pipe. The present invention is an improvement motor vehicles that provide dynamic and artistic aspects, in some cases act as a hot exhaust gas heat dissipater, noise abatement system, noxious gas dilution mechanism and/or an eye-catching safety feature. Thus, the present invention is an improvement in a motor vehicle having an internal combustion motor and a wheel drive mechanism, wherein the motor has an exhaust system connected thereto.

It includes a) an exhaust system having a first exhaust pipe and a second exhaust pipe with the first exhaust pipe being in a fixed position relative to the internal combustion motor, and the second exhaust being rotatably connected to the first exhaust pipe, and b) an exhaust pipe drive mechanism connected to the second exhaust pipe for rotation of the second exhaust pipe. The second exhaust pipe is the rotating pipe and may be the actual end pipe or an intermediate section of pipe. For example, in the case of the semi or other truck or vehicle having vertical or diagonal pipes, or vehicles having externally exposed horizontal pipes, a mid-section thereof may be the rotating second pipe.

In some embodiments of the present invention device, the improvement further includes an annular connector located between the first exhaust pipe, the annular connector having disparate portions rotatable with respect to one another and having a plurality of bearings. By "annular" is meant donut shaped, with a hole in the center (located about the first, fixed pipe), or one or more segmented arcs thereof. The bearings may be any rotating bearing arrangement, e.g., arms with individual rollers, but are preferably selected from the group consisting of ball bearings and roller bearings. In some preferred embodiments of the present invention device, there are at least two of these annular connectors, especially when the second pipe is more than one foot or so in length.

The exhaust pipe drive mechanism may be any that will rotate the second exhaust pipe. These include drives that derive power from anywhere on the motor vehicle, i.e., taking power or driving force from the motor, the main wheel drive, the wheels themselves, the main battery, etc., or it may have its own power source and thus be independent of the power of the motor vehicle itself. These independent power sources may be onboard or derived from ambient air, i.e., wind blowing turbines, especially the ram air wind created when the motor vehicle is moving forward. Thus, the exhaust pipe drive mechanism may be a plurality of wind vanes connected to the second exhaust pipe. These wind vanes may be positioned to be exposed to and driven by exhaust gases, relying on internal combustion exhaust gases for power. Or, these wind vanes may be positioned to be exposed to and driven by ambient (outside) air flow against the plurality of wind vanes. Or, both, that is, these wind vanes may be at least partially positioned to be exposed to and driven by ambient air flow against the plurality of wind vanes, and at least partially positioned to be exposed to and driven by ambient air flow against the plurality of wind vanes.

Alternatively, the present invention exhaust pipe drive mechanism may be a mechanically connected take-off from the device wheel drive mechanism, or, it could be a mechanically connected take-off from the motor. For example, the exhaust pipe drive mechanism may be a wheel-driven friction drive mechanism, that is, a small friction wheel against a tire or rim that would mechanically power the pipe drive mechanism or would drive a generator to run an electric motor pipe drive. In some embodiments of the present invention device, the exhaust pipe drive mechanism is an independent electric motor with its own battery and second exhaust pipe connecting components.

In some embodiments of the present invention device, the motor vehicle (as with most conventional vehicles) includes a conventional main battery for starting and operating electric components, and the exhaust pipe drive mechanism is an electric motor with second exhaust pipe connecting components, the electric motor being connected to the main battery.

In some preferred embodiments of the present invention device, the improvement which further includes at least one visual enhancement to the second exhaust pipe. The visual enhancement may be any decoration, paint, decal, emblem, symbol, or other feature, such as fins, rhinestones, studs, flutes, grills, etc. In some embodiments of the present invention, the enhancement may be selected from the group consisting of cut-outs, embossments, outshoots, add-ons and topographical variations. Cut-outs are basically holes; embossments are stamped or pressed indentations; outshoots are reverse embossments; add-ons are additional parts, like fins, that may be welded, riveted, bolted or otherwise attached; topographical variations are surface changes, such as polished and brushed metal sections, grooves, cross-hatchings, etches, etc.

In some embodiments of the present invention device, the visual enhancement is lighting on the second exhaust pipe that rotates with the second exhaust pipe. In other embodiments, the visual enhancement is a combination of at least one cut-out and at least one fixed backlight aligned with the cut-out(s) to create a strobe effect when the backlight is on and the second exhaust pipe is rotating.

In many embodiments of the present invention device, there are at least two separate second exhaust pipes that rotate. These two separate exhaust pipes may be drive-connected and rotate synchronically with one another or they may be independent of one another.

In some embodiments of the present invention, the second exhaust pipe may further include an extension having a plurality of pipes arranged symmetrically about an imaginary axis of rotation.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
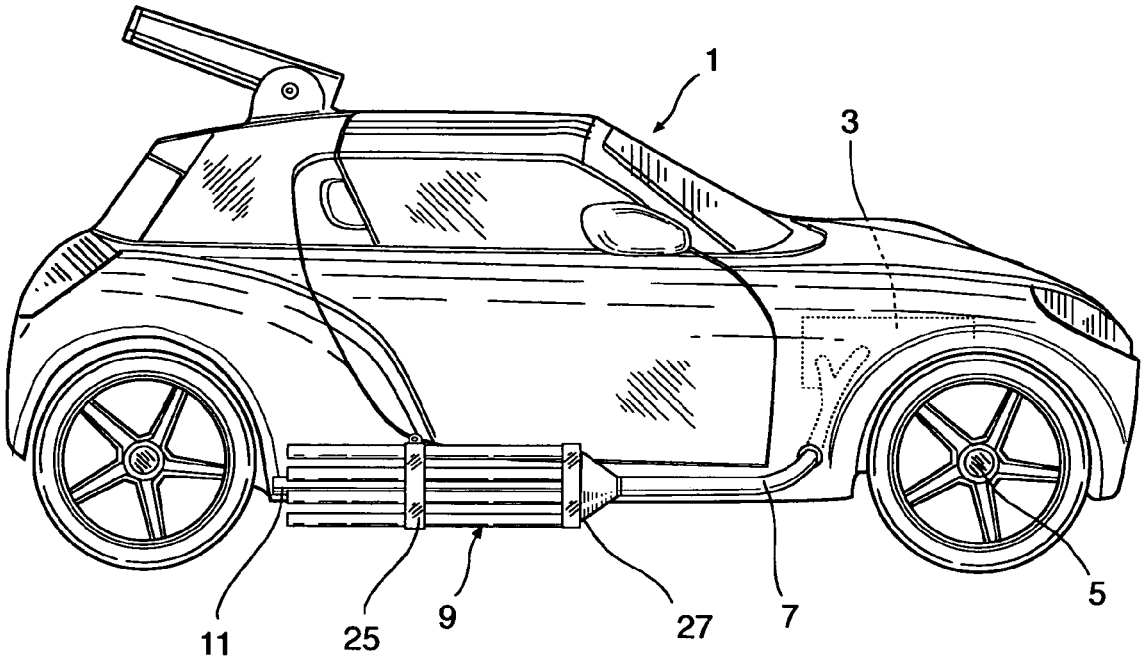
FIG. 1 illustrates a side view of a present invention motorcycle with a rotating tailpipe having a plurality of tubes similar to a rotary machine gun turret.

FIG. 1 illustrates a side view of a present invention four wheeled, two axle motor vehicle 1 having an internal combustion engine motor 3, a conventional front wheel drive mechanism 5, and a first exhaust pipe 7 that is fixed relative to motor 3. There is a second, rotating exhaust pipe 9 having a plurality of tubes, numbered individually in FIG. 2 as tubes 13, 15, 17, 19, 21 and 23, similar to a rotary machine gun turret. In this case, first exhaust pipe 7 has a rearward smaller cross-section piece 11 that extends slightly beyond the rotating tubes pipe, as shown. There is a two piece annular connector 25 with a stationary outside and a rotating inside with bearings therebetween. The outside is fixed to the vehicle and the inside is fixed to the rotating second pipe 9. The is a pipe drive mechanism 27, discussed in further detail below.

Figure 2:
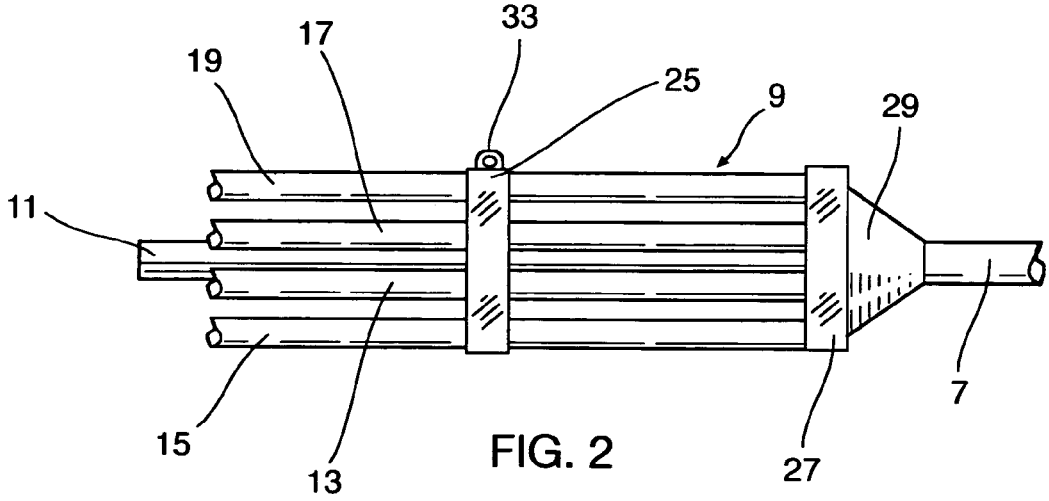
FIGS. 2, 3 and 4 shown side views of details of the present invention rotating tailpipe of FIG. 1.
Figure 4:
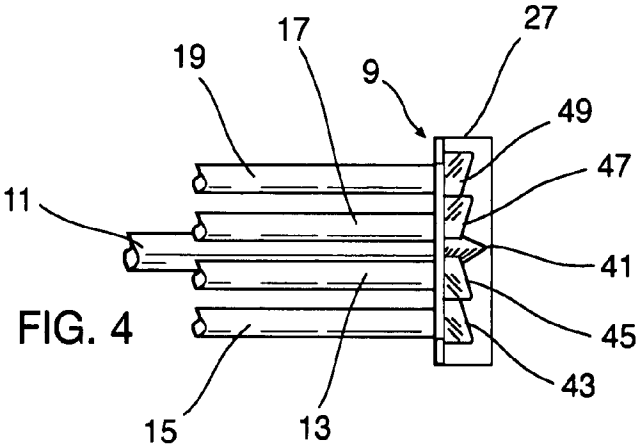
Figure 3:
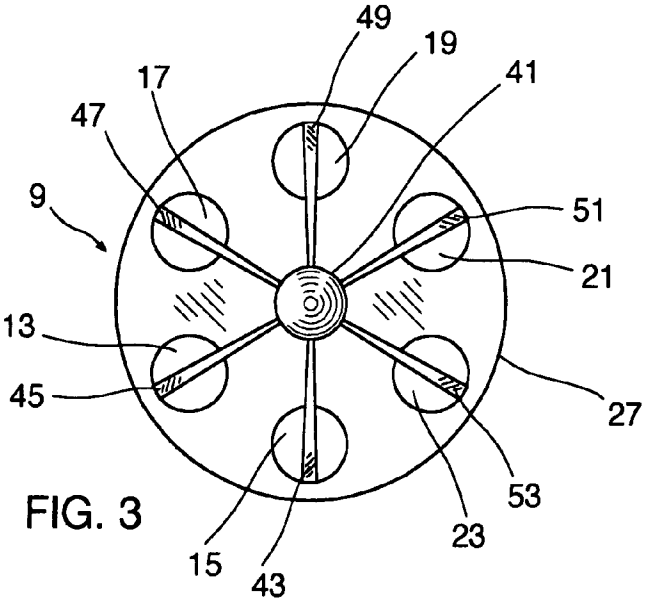
Figure 6:
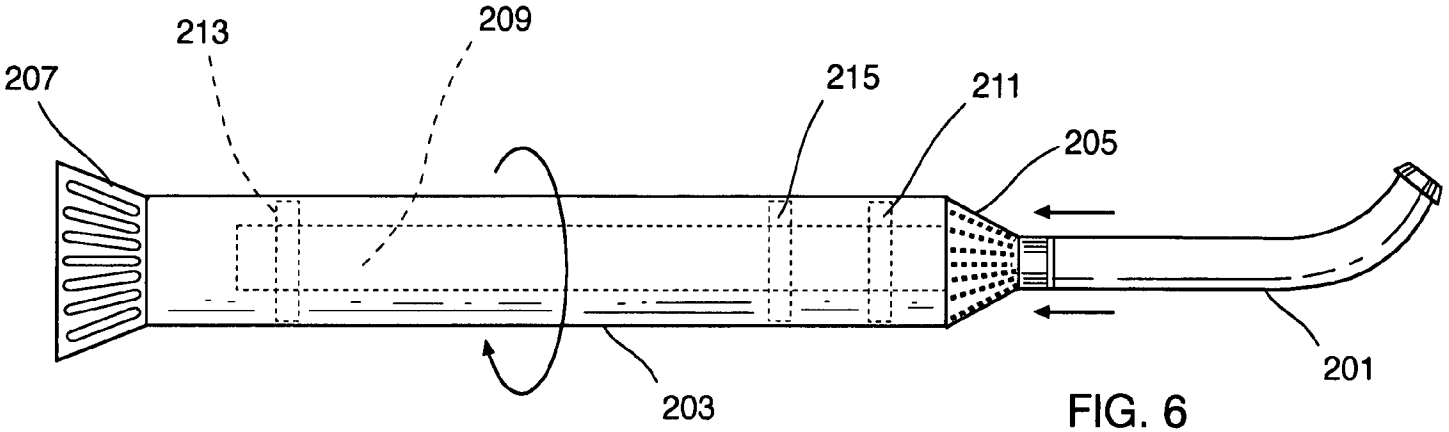
FIGS. 6, 7, 8 and 9 show side views of details of the present invention rotating tailpipe of FIG. 5.
Figure 9:
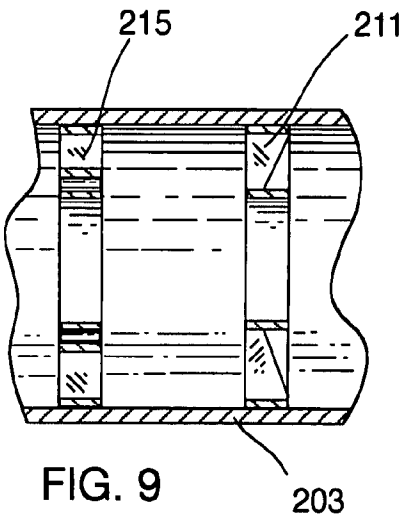
Figure 8:
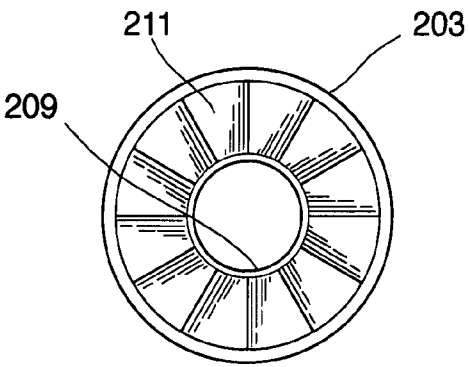
Figure 7:
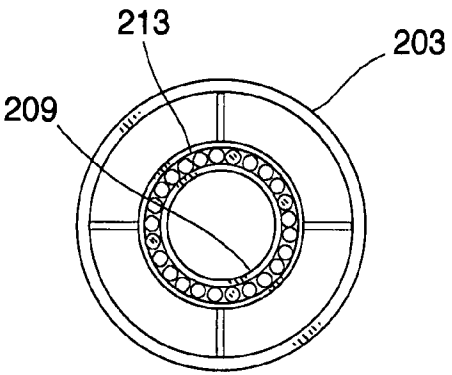

FIGS. 2, 3 and 4 shown side views of details of the present invention rotating exhaust pipe 9 of FIG. 1. In FIG. 2, identical parts from FIG. 1 are repeated and identically numbered. Also, FIG. 2 shows the exhaust gas expansion cone 29 (hidden in FIG. 1) and the relative positions of the pipe drive mechanism 27 and the annular connector 31 with attachment bracket 33. FIG. 3 and FIG. 4 show side and front views of the internal features of the pipe drive mechanism 27. As can be seen in these Figures, there are turbine blades (wind vanes) 43, 45, 47, 49, 51 and 53 located over the concentric pipes and a flow-spreading cone 41 to aid in exhaust gas distribution. When the exhaust gases hit the turbine blades, the entire turret-like second exhaust pipe 9 rotates. In this embodiment, the speed of rotation is directly related to the thrust of the engine exhaust. Revving the engine increases the spin of the exhaust pipe. An identical mirror image arrangement could be included on the opposite side of vehicle 1 (not shown).

Figure 5:
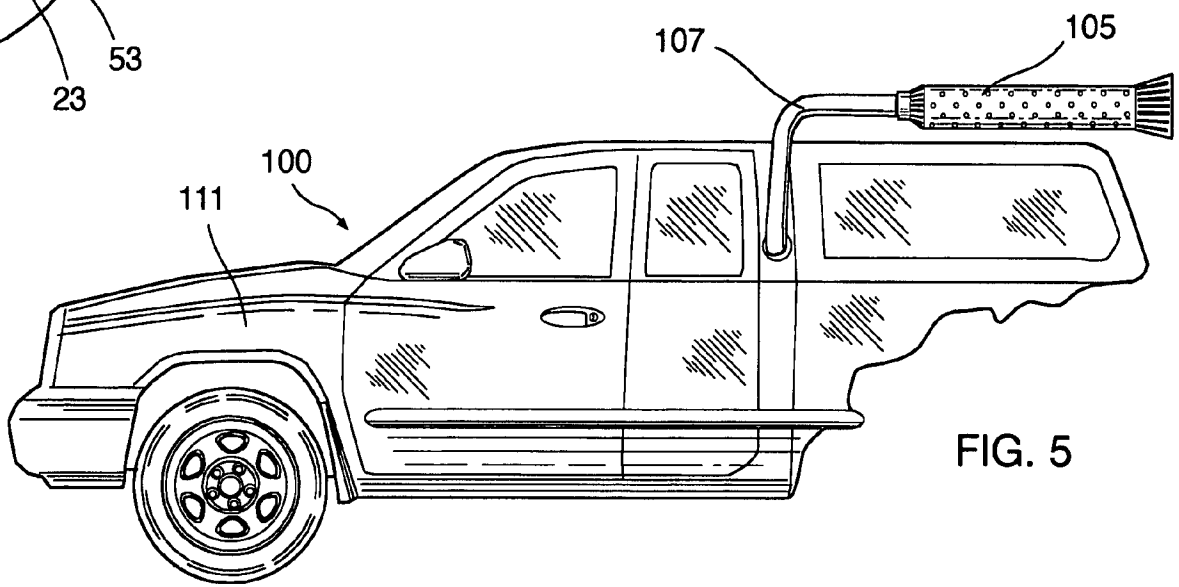
FIG. 5 shows a side and back views of another present invention motorcycle with a rotating tailpipe.

FIG. 5 shows a side view of another present invention motor vehicle 100, representing an SUV or a small truck, with rotating tailpipe 105. First pipe 107 is stationary with respect to vehicle 100, and its conventional motor (not shown) and wheel drive mechanism 115. the rotating pipes have enhancements 125 as shown on pipe 105. This enhancement in the Figure could be studs, embossments, lights, cut-outs with backlighting, or any other discussed above. The pipes 101 and 105 rotate in a fashion identical to that described below with respect to FIGS. 7 through 10.

FIGS. 6, 7, 8 and 9 shown side views of details of the present invention rotating tailpipe of the type shown in FIG. 5, except that the enhancements are excluded to present a cleaner view of the functionality of the pipes and the pipe drive mechanisms. First pipe 201 is a fixed pipe attached to an internal combustion motor (not shown). Second pipe 203 is rotatably attached to pipe 201 with bearing-containing annular connectors 213 and 215, connected to the outer surface of inside section 209 of pipe 201 and to the inner surface pipe 203. At the front of pipe 203 is a fixed open grill 205 for external air to enter pipe 203. Behind this a set of external air-driven wind vanes, such as vane 211, attached to the inside of pipe 203. When the vehicle is driven forward, air rams into the grill 205 and spins vanes 211 and thus spins pipe 203. The speed of the spinning pipe 203 is dependent on the rate of air ramming the vanes, and independent of the speed or RPM's of the motor.

Figure 10:
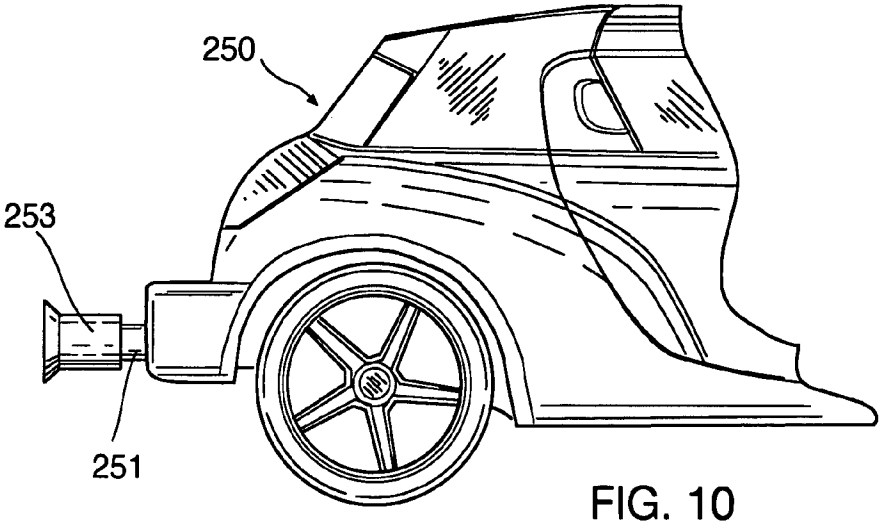
FIGS. 10 and 11 show a partial cut view and detailed partial cut view of a present invention device on an automobile.
Figure 11:
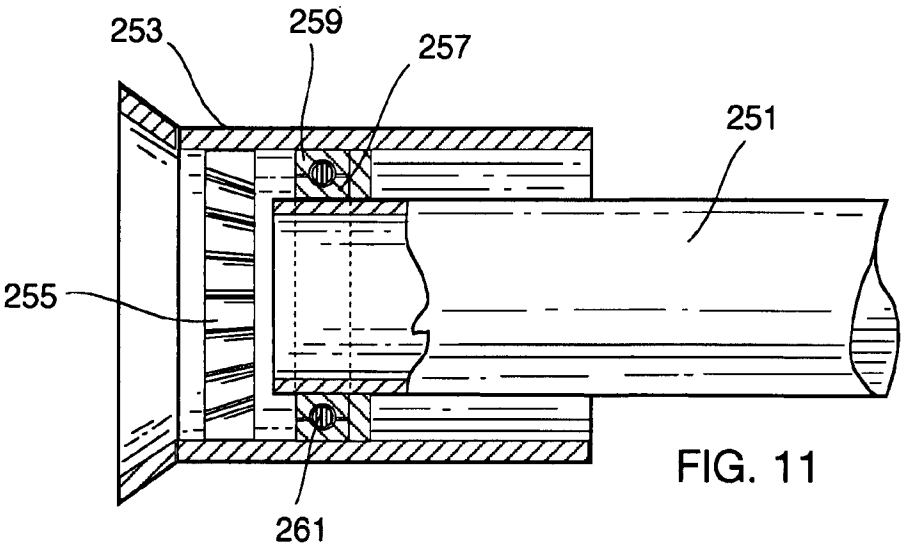

FIG. 10 shows a partial cut view a present invention device on automobile 250 at its rear bumper area, and FIG. 11 shows a detailed partial cut view of the device. Here, fixed, conventional straight exhaust pipe, i.e., first pipe 251, extends behind the rear of automobile 250. Attached to first pipe 251 is an inner ring 257 of an annular connector, its outer ring 261 being attached to the inside of second, rotatable pipe 253. Fitted between the inner ring 257 and the outer ring 259 are a plurality of ball bearings, such as bearing 261. This enables second pipe 253 to freely spin about first pipe 251. Because second pipe 253 has a turbine drive mechanism 255, when exhaust gases pass therethrough, the pipe 253 spins.

Figure 13:
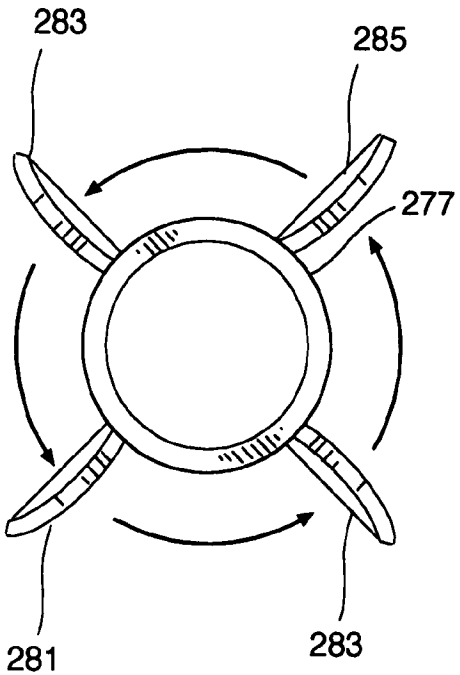
FIGS. 12 and 13 show a side view and detailed top view of a present invention device on a semi truck; and, FIG. 14 shows alternative embodiment present invention rotating tailpipe drive mechanisms.
Figure 12:
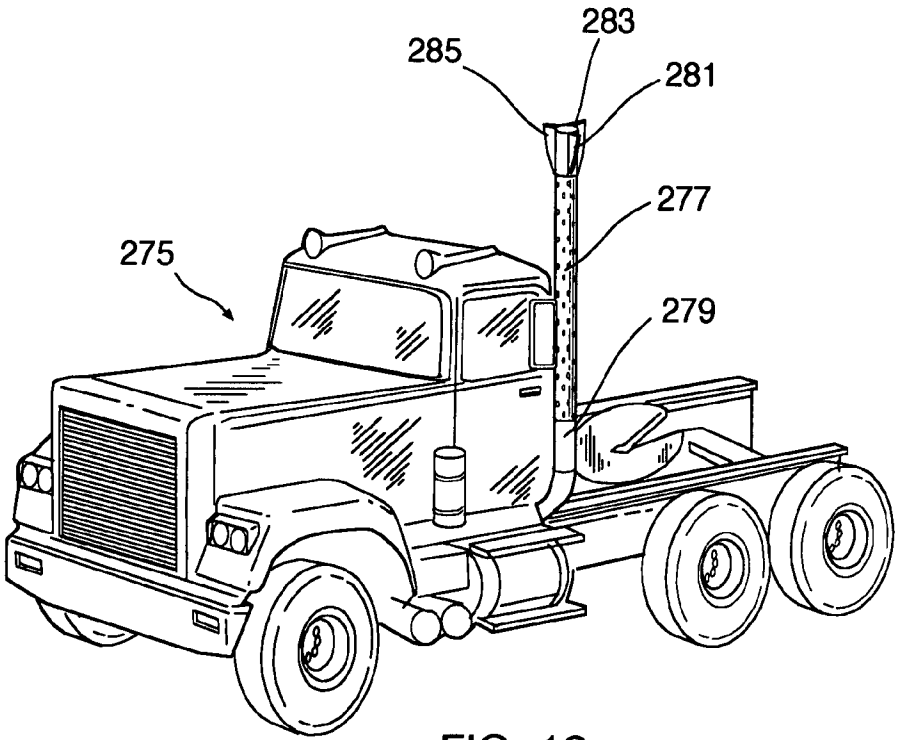

FIG. 12 shows an oblique view of semi truck 275 and present invention spinning vertical exhaust pipe 277, and FIG. 13 shows a detailed top view of the present invention pipe 277. As shown in FIG. 13, the driving mechanism is a set of wind vanes with cups 281, 283, 284 and 287. The spinning (second) exhaust pipe 277 is rotatably nested on fixed first pipe 279 and is driven by the air rammed caused by forward motion of the semi truck 275.

Figure 14:
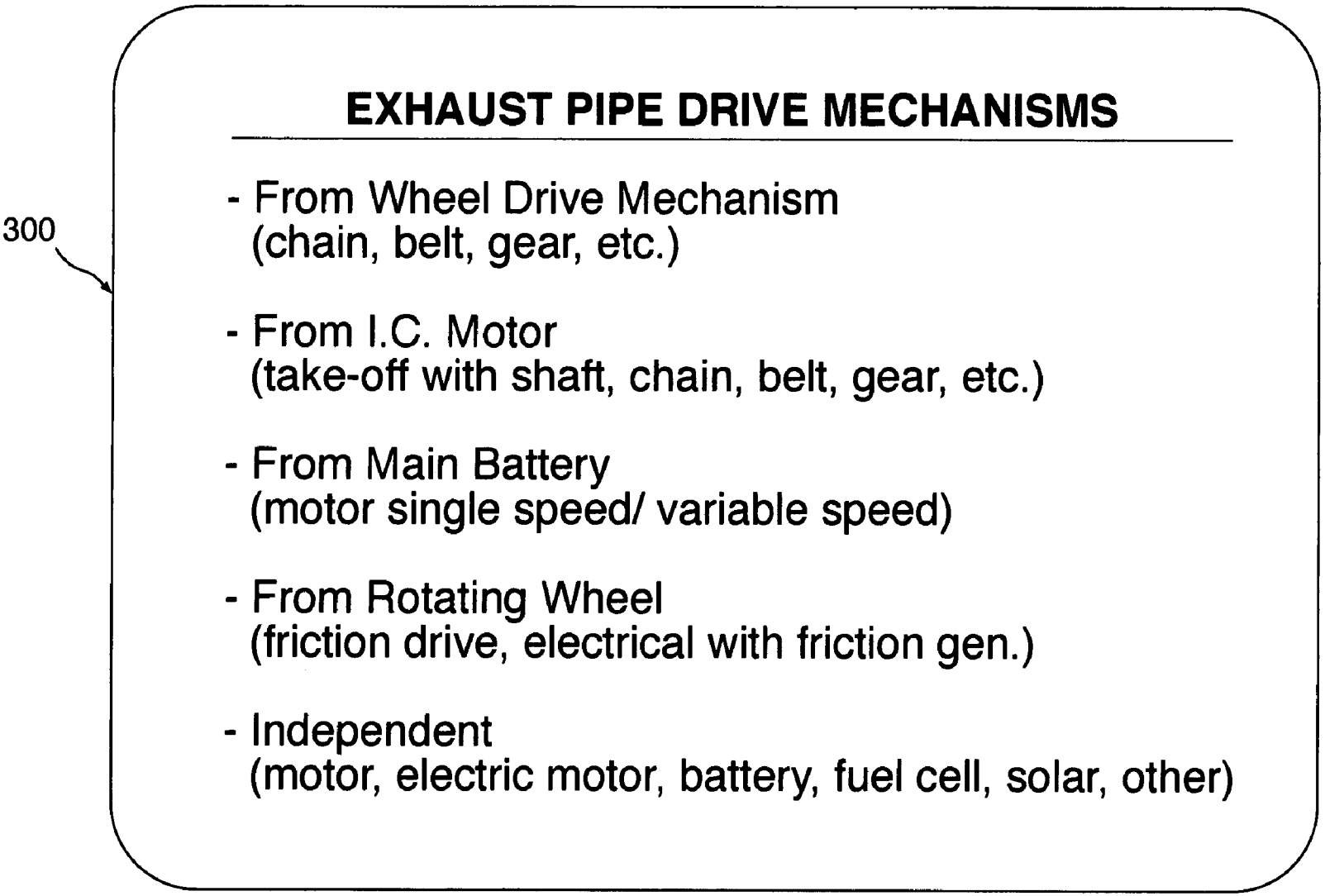

FIG. 14 shows alternative embodiment present invention rotating tailpipe drive mechanisms in chart 300. These include many discussed above as well as some additional alternative arrangements.

Obviously, numerous modifications and variations of the present invention are possible in light of the above teachings. For example, the present invention devices may involve any type of exhaust pipe arrangement, including a single pipe, a set of two or more single pipes from separate exhaust lines, a plurality of single or multiple pipes manifolded from one or more than one main pipe, or any other possible pipe arrangement. The devices may be for all, some or only one of a plurality of pipes on the vehicle. Further, although the devices of the present invention are shown as based on linear or straight line flow of exhaust gases and/or ambient air flow, diverters and/or manifolds could be used to change or even reverse flow direction to move the rotating second pipes, without exceeding the scope of the present invention. It is therefore understood that within the scope of the appended claims, the invention may be practiced otherwise than as specifically described herein.

What is claimed is:

1. In a motor vehicle having at least three wheels and having an internal combustion motor and a wheel drive mechanism, said internal combustion motor having an exhaust system connected thereto, the improvement which comprises:

a) said exhaust system having a first exhaust pipe and a second exhaust pipe said first exhaust pipe being in a fixed position relative to said internal combustion motor, said second exhaust pipe being rotatably connected to said first exhaust pipe; and, b) an exhaust pipe drive mechanism connected to said second exhaust pipe for rotation of said second exhaust pipe relative to said first exhaust pipe so as to freely spin about said exhaust pipe when operating to add dynamic and artistic appearance to said motor vehicle, said exhaust pipe drive mechanism being located in a position selected from the group consisting of a) inside said first exhaust pipe, b) on said second exhaust pipe on the outside of said second exhaust pipe, c) adjacent a wheel, and d) connected to and in the vicinity of a motor or motor drive mechanism, said exhaust pipe drive mechanism being connected to said second exhaust pipe for rotation thereof.

2. In the device of claim 1, the improvement which further includes an annular connector located between said first exhaust pipe and said second exhaust pipe, said annular connector having disparate portions rotatable with respect to one another and having a plurality of bearings located therebetween wherein at least one of said disparate portions is attached to said first exhaust pipe and at least one other of said disparate portions is rotatable relative to said first exhaust pipe.

3. In the device of claim 2, the improvement further wherein said bearings are selected from the group consisting of ball bearings and roller bearings.

4. In the device of claim 2, the improvement which further includes at least two of said annular connectors.

5. In the device of claim 1, the improvement further wherein said exhaust pipe drive mechanism includes a plurality of wind vanes.

6. In the device of claim 5, the improvement further wherein said wind vanes are positioned within said first exhaust pipe to be exposed to and are driven by exhaust gases passing through said exhaust pipe.

7. In the device of claim 5, the improvement further wherein said wind vanes are positioned on the outside of said second exhaust pipe to be exposed to and driven by ambient air flow against said plurality of wind vanes.

8. In the device of claim 5, the improvement further wherein said wind vanes are at least partially positioned on said outside of said second exhaust pipe and adjacent said second exhaust pipe to be exposed to and driven by ambient air flow against said plurality of wind vanes.

9. In the device of claim 1, the improvement further wherein said exhaust drive mechanism is a mechanically connected take-off from the device wheel drive mechanism.

10. In the device of claim 1, the improvement further wherein said exhaust drive mechanism is a mechanically connected take-off from the motor.

11. In the device of claim 1, the improvement further wherein said exhaust drive mechanism is an independent electric motor with its own battery and its own connecting components.

12. In the device of claim 1, the improvement further wherein said motor vehicle includes a conventional battery for starting and operating electric components, and wherein said accessory drive mechanism is an electric motor with connecting components, said electric motor being connected to said battery.

13. In the device of claim 1, the improvement which further comprises including at least one visual enhancement connected to said second exhaust pipe that is selected from the group consisting of cut-outs, embossments, outshoots, add-ons and topographical variations.

14. In the device of claim 13, the improvement further wherein said visual enhancement is lighting on said second exhaust pipe that rotates with said second exhaust pipe.

15. In the device of claim 13, the improvement wherein said visual enhancement is a combination of at least one cut-out and at least one fixed backlight aligned with said at least one cut-out to create a strobe effect when said backlight is on and said second exhaust pipe is rotating.

16. In the device of claim 1, the improvement further wherein there are at least two separate second exhaust pipes that rotate independently of one another.

17. In the device of claim 16, the improvement further wherein there are at least two separate exhaust pipes that are drive-connected and rotate synchronically with one another.

18. In the device of claim 1, the improvement further wherein said exhaust pipe drive mechanism is adjacent a wheel and is a wheel-driven friction drive mechanism.

19. In the device of claim 1, the improvement further wherein at least one of said rotating second exhaust pipe and said exhaust pipe drive mechanism has an external housing connected to said first exhaust pipe.

20. In the device of claim 1, the improvement further wherein said rotating second exhaust pipe includes a fixed outer housing connected to said exhaust pipe.

* * * * *